US009197018B2

(12) United States Patent
Garofalo et al.

(10) Patent No.: US 9,197,018 B2
(45) Date of Patent: Nov. 24, 2015

(54) CHILD-RESISTANT PLUG

(71) Applicant: NUK USA LLC, Tarrytown, NY (US)

(72) Inventors: James Garofalo, Reedsburg, WI (US); Brooks Rorke, Guilford, CT (US)

(73) Assignee: NUK USA LLC, Tarrytown, NY (US)

( * ) Notice: Subject to any disclaimer, the term of this patent is extended or adjusted under 35 U.S.C. 154(b) by 30 days.

(21) Appl. No.: 14/064,369

(22) Filed: Oct. 28, 2013

(65) Prior Publication Data

US 2014/0242830 A1 Aug. 28, 2014

Related U.S. Application Data

(60) Provisional application No. 61/770,276, filed on Feb. 27, 2013.

(51) Int. Cl.

| | |
|---|---|
| ***H01R 13/639*** | (2006.01) |
| *H01R 103/00* | (2006.01) |
| *H01R 24/28* | (2011.01) |

(52) U.S. Cl.

CPC ..... *H01R 13/6395* (2013.01); *H01R 24/28* (2013.01); *H01R 2103/00* (2013.01)

(58) Field of Classification Search

USPC ..... 439/373, 367, 314, 459, 345

See application file for complete search history.

(56) References Cited

U.S. PATENT DOCUMENTS

| | | | | | |
|---|---|---|---|---|---|
| 2,199,560 | A | * | 5/1940 | Faller | 439/314 |
| 2,484,558 | A | | 10/1949 | Eisner | |
| 2,659,059 | A | * | 11/1953 | Johnson | 439/373 |
| 3,161,450 | A | * | 12/1964 | Goodenough | 439/304 |
| 3,775,729 | A | | 11/1973 | Casper | |
| 3,811,104 | A | * | 5/1974 | Caldwell | 439/135 |
| 3,990,758 | A | | 11/1976 | Petterson | |
| 4,105,274 | A | * | 8/1978 | Casey | 439/368 |
| 4,111,509 | A | | 9/1978 | Novak | |
| 4,457,571 | A | * | 7/1984 | Lavine et al. | 439/369 |
| 4,618,200 | A | | 10/1986 | Roberts et al. | |
| 4,743,206 | A | | 5/1988 | Imhoff | |
| 4,803,307 | A | * | 2/1989 | Shotey | 174/67 |
| 4,840,577 | A | * | 6/1989 | Prouty | 439/373 |
| 5,067,907 | A | * | 11/1991 | Shotey | 439/135 |
| 5,180,886 | A | * | 1/1993 | Dierenbach et al. | 174/66 |
| 5,194,013 | A | | 3/1993 | Propp | |
| D353,580 | S | * | 12/1994 | Woehler | D13/173 |
| 5,480,318 | A | | 1/1996 | Garrison | |
| 5,599,196 | A | | 2/1997 | Powell et al. | |
| 5,655,924 | A | | 8/1997 | Cross et al. | |
| 5,727,953 | A | * | 3/1998 | Pasholk | 439/21 |
| 5,934,919 | A | * | 8/1999 | Cross et al. | 439/136 |
| 6,071,142 | A | | 6/2000 | Blackman | |
| 6,491,539 | B1 | | 12/2002 | Johnston | |
| 7,014,493 | B1 | * | 3/2006 | Battard | 439/373 |
| 7,510,429 | B1 | * | 3/2009 | Savicki et al. | 439/535 |

* cited by examiner

*Primary Examiner* — Alexander Gilman
(74) *Attorney, Agent, or Firm* — Husch Blackwell LLP

(57) ABSTRACT

A child-resistant plug includes a plug body, at least one prong, and at least one tab extending from the plug body. In one embodiment, a tab is positioned adjacent each of the upper and lower portions of the plug body and each tab is attached to the plug body by a hinging member. The hinging member allows the tabs to rotate between a folded and an unfolded position. When a tab is in its unfolded position, the tab is sized and positioned such that an aperture in the tab aligns with a pre-existing aperture in an electrical outlet cover plate. A fastening member may be used to attach the tab to the cover plate, preventing a child from unplugging a device or accessing the electrical socket. When the tab is attached to the cover plate, and a person pulls the plug or cord with a pre-determined amount of force, the hinging member will break, and the plug will release from the electrical socket.

21 Claims, 4 Drawing Sheets

CHILD-RESISTANT PLUG

CROSS-REFERENCE TO RELATED APPLICATIONS

The present application claims priority to and incorporates herein by reference U.S. Provisional Patent Application Ser. No. 61/770,276 filed on Feb. 27, 2013.

BACKGROUND OF THE INVENTION

Conventional electrical plugs can be easily inserted into and removed from outlet receptacle sockets so as to provide quick and convenient connection with a source of electrical power. However, the ease of removal can be disadvantageous, especially in instances where a small child may be apt to remove the plug from the socket or in cases where the plug supplies power to a vital appliance or device. Not only will the removal of the plug terminate the supply of power to the appliance or device to which it is connected, but it can also present safety concerns, as the electrical socket will be exposed and accessible. Equally as dangerous are cases where the plug is only partially removed thereby exposing the prongs carrying electrical current.

If an issue or emergency involving an electrical appliance or device occurs, often the quickest way to remedy the issue is to unplug the appliance or device from the outlet to which it is connected thereby terminating the supply of power. However, if the plug is fixedly secured to the outlet, it can be very difficult to unplug it in a quick manner.

In other instances, where small children are not present or where the plug is not connected to a vital appliance or device, it is preferable that the plug be adapted for easy insertion and removal from outlet receptacle sockets.

Residential and commercial buildings commonly have a variety of electrical receptacles installed therein. For example, modern building codes require ground fault circuit interrupter (GFCI) receptacles to be installed in locations near sources of water, such as faucets and the like. However, GCFI receptacles are typically not installed elsewhere and instead standard receptacles are installed in locations away from sources of water. Typically, the holes available for mounting cover plates over GFCI and standard receptacles are located in different places. Additionally, most electrical receptacles are duplex receptacles meaning that they include two sockets adjacent to one another. In some cases, both sockets may be used simultaneously.

It is therefore desirable to provide a plug that may be semi-permanently connected to an electrical outlet, yet may be removed quickly with a requisite amount of force in case of an emergency. It is also desirable to provide a plug that may be inserted into the sockets of various outlet receptacles, including both GFCI and standard outlet receptacles, without interfering with or preventing other plugs from being inserted into adjacent sockets.

SUMMARY OF THE INVENTION

The present invention relates to embodiments of a child-resistant plug. Particularly, the plug includes a plug body, a cord, and a prong. In addition, the plug contains a tab which is attached to the plug body by a hinging member. The tab may include at least one aperture. The hinged member preferably allows the tab to rotate between a folded and an unfolded position. When the tab is in its unfolded position, the tab is sized and positioned such that an aperture in the tab aligns with a pre-existing aperture in an electrical outlet cover plate. The tab may be attached to the upper or lower portion of the plug body via the hinging member. Alternatively, there may be a tab attached to each of the upper and lower portion of the plug body via the hinging member. Either tab may contain an upper and a lower aperture, or just one of an upper or lower aperture.

The specific pre-existing aperture in an electrical wall outlet cover plate to which the aperture on the tab aligns depends on whether the plug is attached to a ground fault circuit interrupter outlet, or a standard outlet. It also depends on whether the plug is attached to the upper or lower socket of the outlet.

For example, when the child-resistant plug is attached to an upper socket of a ground fault circuit interrupter outlet, a tab attached to the upper portion of the plug body will have an aperture that will align with a pre-existing aperture on the upper portion of the cover plate.

Alternatively, when the child-resistant plug is attached to a lower socket of a ground fault circuit interrupter outlet, a tab attached to the lower portion of the plug body will have an aperture that will align with a pre-existing aperture on the lower portion of the cover plate.

The tabs are fastenable to the cover plates of the ground fault circuit interrupter or standard outlets. The aperture or apertures preferably align with at least one pre-existing aperture on a cover plate. Typically, a screw or other fastening member is inserted into the aligned apertures, and a screw driver or similar tool is sufficient to install the tab on a semi-permanent basis.

The hinging member preferably connects the plug body to a tab. It allows the tab to move hingedly about the plug body. When the tab is fastened to the cover plate, the tab is preferably in its unfolded position. In the unfolded position, a sufficient pre-determined pull force, such as from an adult, may cause the hinging member to break, and the plug would be removable from the outlet. This mechanism allows an adult to detach the plug from the outlet in an emergency situation.

The plug body may also contain a structure for retaining a tab in its folded position. For example, the plug body may contain a projection which extends from the plug body. The projection is positioned such that when a tab is in its folded position, the projection aligns with an aperture on the tab. The projection may be cone-shaped, and may have a slit defined therethrough so that when the projection is inserted into the aperture on the tab, the projection may compress and snappingly engage the aperture.

DETAILED DESCRIPTION OF THE INVENTION

Figure 1:
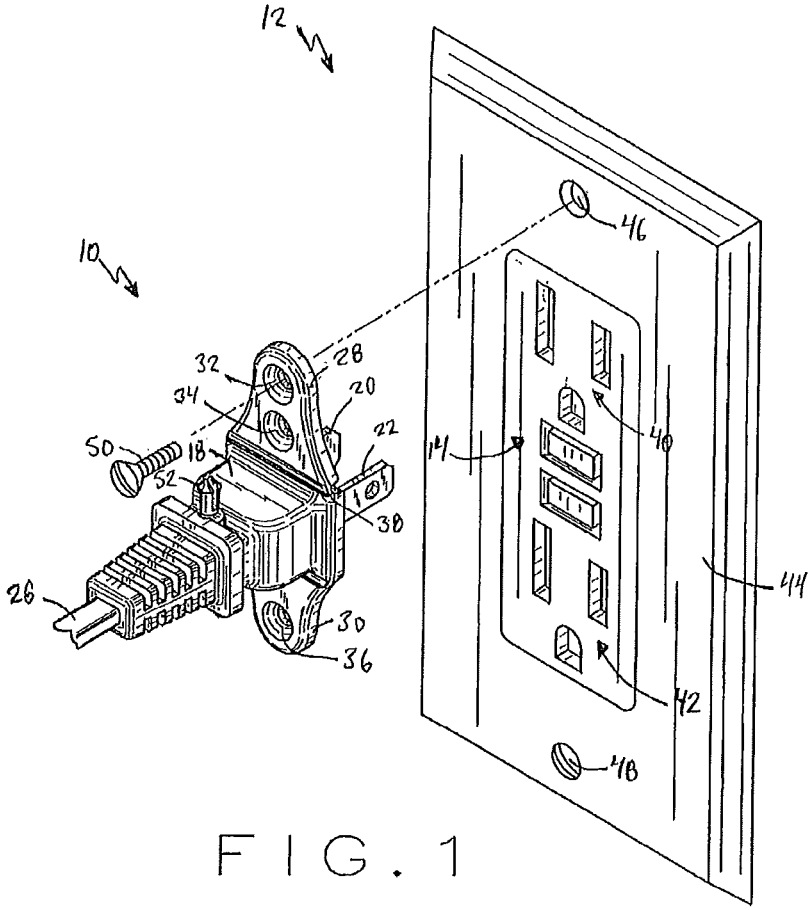
FIG. 1 is a perspective view of a child-resistant plug constructed in accordance with the teachings of the present invention aligned for connection with the upper socket of a GFCI electrical outlet.
Figure 2:
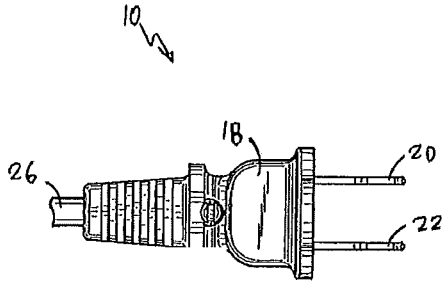
FIG. 2 is a top plan view of the child-resistant plug of FIG. 1.
Figure 3:
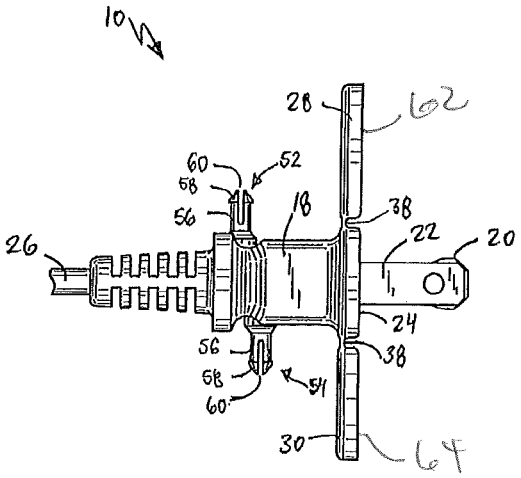
FIG. 3 is a side elevational view of the child-resistant plug of FIG. 1 illustrating the upper and lower tabs in unfolded positions.
Figure 4:
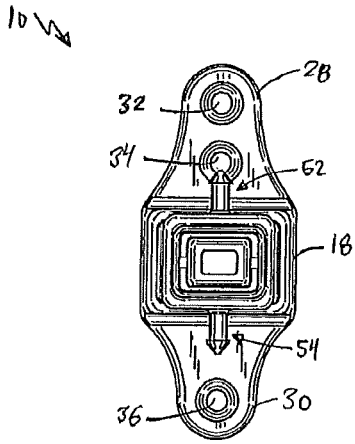
FIG. 4 is a rear elevational view of the child-resistant plug of FIG. 1 illustrating the upper and lower tabs in unfolded positions.

Referring to the drawings particularly by reference numbers wherein like numerals refer to like parts, FIG. 1 illustrates one embodiment of a child-resistant plug 10 designed for connection with an electrical outlet 12. In particular, the plug 10 is designed for semi-permanent securement to an outlet 12 so as to prevent small children from removing the plug 10 from the outlet 12, as well as to prevent other unintentional removal of the plug 10. The plug 10 is also adapted such that it may be quickly removed from the outlet 12 by an adult or adolescent exerting a requisite amount of pull force during an emergency.

As discussed in greater detail below, the plug 10 may be suitable for connection with outlets 12 having a variety of receptacles, including a ground fault circuit interrupter (GFCI or GFI) duplex receptacle 14 (FIG. 1), a standard duplex receptacle 16 (FIGS. 6-8), a combination device that includes both a switch and an electrical socket, or any other suitable devices or receptacles now known or hereafter developed.

The plug 10 includes a non-conducting body 18 having prongs 20 and 22 extending from a first side in parallel fashion so that the plug 10 may be connected to an outlet receptacle socket 40, 42, 72 or 74 Typically, prongs 20 and 22 are referred to as "neutral" and "hot" prongs, respectively. The plug may further include a third prong (not shown) which is typically referred to as a "ground" prong. A cord 26 extends from a second side of the plug 10 and may be attached to an appliance, machine, tool or other electrical or electronic device.

In one embodiment, the plug 10 includes upper and lower tabs 28 and 30, each having one or more apertures 32, 34 and 36 defined therethrough. It will be appreciated that in other embodiments, the plug 10 may include only a single tab or may have one or more tabs extending from the sides thereof.

As illustrated in the figures, a hinge member 38 is located between the plug body 18 and each of the tabs 28 and 30 permitting hinged movement of the tabs 28 and 30 relative to the plug body 18. In particular, the hinge members 38 allow the tabs 28 and 30 to be selectively moved between folded and unfolded positions.

In one embodiment, each hinge member 38 includes a thinned area to provide a "living hinge." The thickness of such a thinned area of the hinge members 38 may be in the order of 0.005 inches to 0.10 inches, for example. In one embodiment, the hinge members 38 are thin enough so that they may become ruptured or broken when an adult pulls on the plug 10 with a predetermined amount of force so that the plug 10 may be quickly removed from the outlet 12 in case of an emergency. In that same embodiment, the hinge members 38 are thick enough such that they will not break when the plug 10 is pulled by a small child. The plug 10, including its body 18 and tabs 28 and 30, may be molded as an integral unit with the living hinge members 38 therebetween and may be molded from a polymeric material such as low density polyethylene or other suitable polymeric materials.

In order to allow other plugs to be inserted into adjacent sockets of the receptacles 14 and 16, the upper and lower tabs 28 and 30 may be optionally folded back as demonstrated in the figures. The plug 10 can include means for retaining the tabs 28 and 30 in folded positions. In one embodiment, the plug includes upper and lower projections 52 and 54 extending from the body portion 18. The projections 52 and 54 may be of any suitable shape and configuration and, as shown in the figures can include a post 56 having a pointed conical end or "arrowhead" 58 located at the terminal end thereof, both of which have a slit 60 defined therethrough. The pointed conical ends 58 of the projections 52 and 54 assist in aligning the projections 52 and 54 with the apertures 32 and 36 of the tabs 28 and 30 when the tabs 28 and 30 are being rotated to their folded positions. The slit 60 allows the pointed conical ends 58 of the projections 52 and 54 to become compressed as they are passing through the apertures 32 and 36. The apertures 32 and 36 may snappingly engage the projections 52 and 54 when the tabs 28 and 30 are folded back. The connection between the apertures 32 and 36 and the projections 52 and 54 may be an interference fit. The apertures 32, 34 and 36 extending through the tabs 28 and 30 may be chamfered or beveled so as to (1) conform to a beveled head of a screw 50 and (2) engage and guide the ends 58 of the projections.

Figure 6:
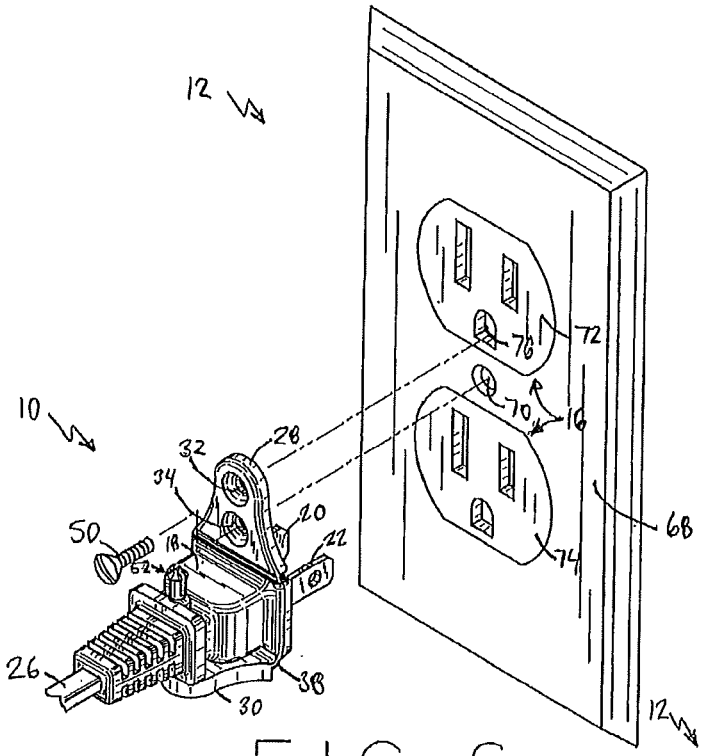
FIG. 6 is a perspective view of a child-resistant plug constructed in accordance with the teachings of the present invention aligned for connection with the lower socket of a standard electrical outlet.
Figure 7:
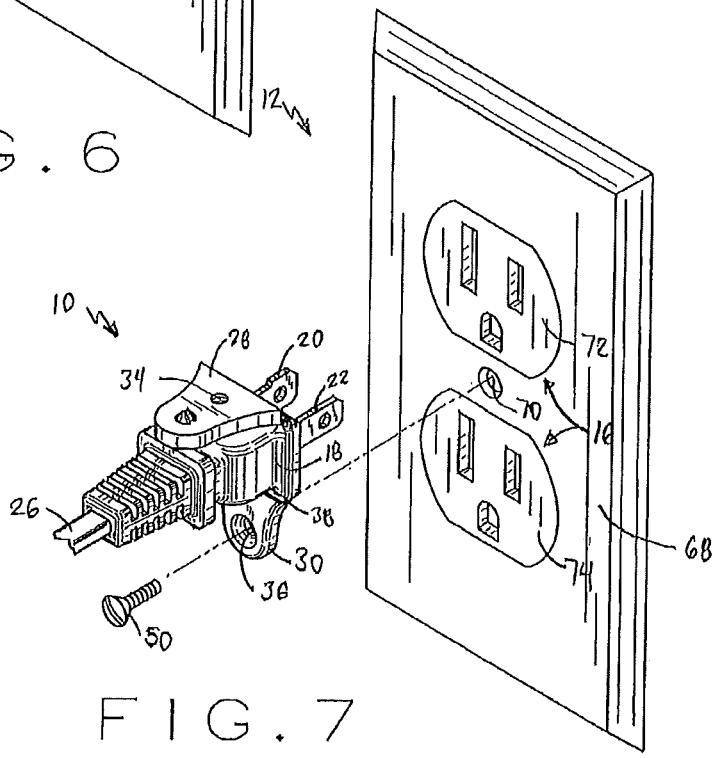
FIG. 7 is a perspective view of a child-resistant plug constructed in accordance with the teachings of the present invention aligned for connection with the upper socket of a standard electrical outlet.

The upper projection 52 may be positioned such that it is engaged by the upper aperture 32 of the upper tab 28 when the upper tab 28 is folded back as shown in FIG. 7 in order to maintain the upper tab 28 in its folded position. Likewise the lower projection 54 may be positioned such that it is engaged by the aperture 36 of the lower tab 30 when the lower tab 30 is folded back as shown in FIGS. 5 and 6 in order to maintain the lower tab 30 in its folded position.

The tabs 28 and 30 include faces 62 and 64 that lie in the same general plane as a face 24 of the plug body 18 when the tabs 28 and 30 are in their unfolded, natural positions. As such, the plug body 18 and the tabs 28 and 30 are designed to lie generally flush against the receptacles 14 and 16 and cover plates 44 and 68. When the tabs 28 and 30 are folded back, the faces 62 and 64 may be generally perpendicular to the face 24 of the plug body 18.

As mentioned above, the plug 10 can be connected to outlets 12 having a variety of receptacles.

Figure 5:
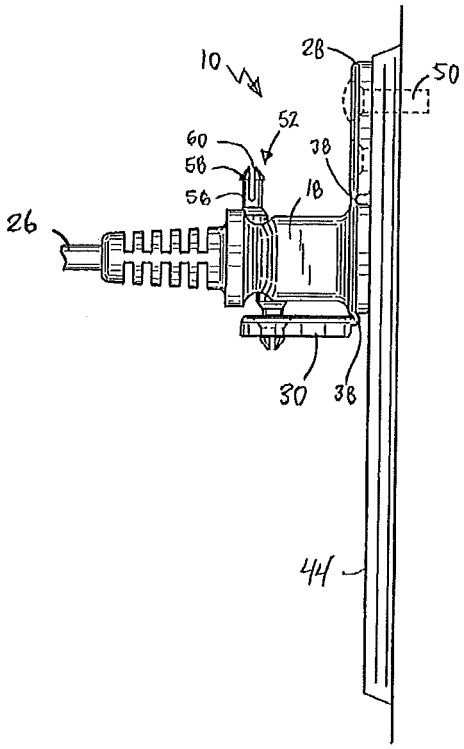
FIG. 5 is a side elevational view of the child-resistant plug of FIG. 1 inserted into the upper socket of a GFCI electrical outlet and having the upper tab coupled to the outlet with a screw and the lower tab retained in a folded back position.

As depicted in FIGS. 1 and 5, the plug 10 may be coupled to an outlet 12 having a GFCI receptacle 14. As shown, when the plug 10 is inserted into the upper socket 40 of the GFCI receptacle 14, the upper aperture 32 of the upper tab 28 is in line with upper aperture 46 of the outlet's cover plate 44. When the plug 10 is semi-permanently connected to the outlet 12 as illustrated in FIG. 5, a screw 50 passes through the upper aperture 32 of the upper tab 32, through the upper aperture 46 of the plate 44 and is threaded into a pre-existing aperture in the framework (not shown) of the receptacle 14. In other words, the screw 50 is threaded through the same aperture that a screw used to attach the plate 44 to the receptacle 14 would normally be threaded through. As such, only a screw driver or similar tool is required for installing the plug 10 in a semi-permanent fashion.

As demonstrated in FIG. 6, the plug 10 may be coupled to an outlet 12 having a standard receptacle 16. As shown, when the plug 10 is inserted into the lower socket 74 of the standard receptacle 16, the lower aperture 34 of the upper tab 28 is in line with center aperture 70 of the outlet's cover plate 68. When the plug 10 is semi-permanently connected to the outlet 12, the screw 50 passes through the lower aperture 34 of the upper tab 28, through the center aperture 70 of the plate 68 and is threaded into a pre-existing aperture in the framework (not shown) of the receptacle 16. Again, the screw 50 is threaded through the same aperture that a screw attaching the plate 68 would normally be threaded through. As depicted, the lower tab 30 may optionally be retained in a folded back position. Additionally, as shown in FIG. 6, the upper aperture 32 of the upper tab 28 is in line with the ground prong slot 76 of the upper socket 72. As such, it may be possible for a plug, including one having a ground prong, to be inserted into the upper socket 72.

As illustrated in FIG. 7, when the plug 10 is inserted into the upper socket 72 of a standard receptacle 16, the aperture 36 of the lower tab 30 is in line with center aperture 70 of the outlet's cover plate 68. As explained above, the screw 50 is threaded into a pre-existing aperture in the framework (not shown) of the receptacle 16. As depicted, the upper tab 28 may be retained in a folded back position so that a second plug may be inserted into the upper receptacle 72.

Figure 8:
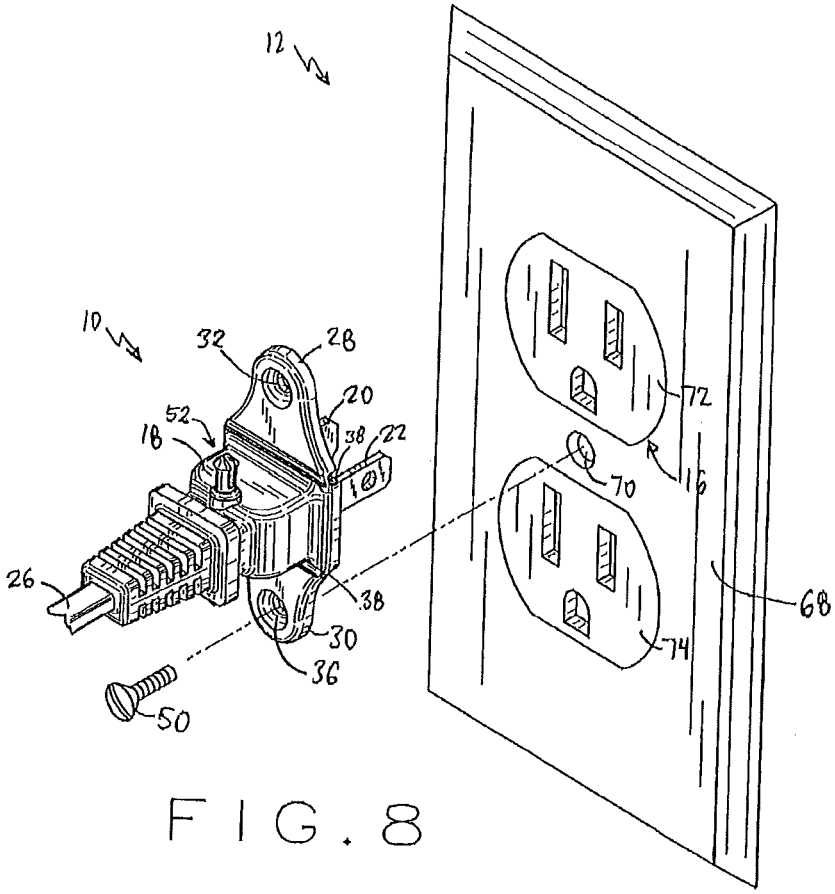
FIG. 8 is a perspective view of another embodiment of a child-resistant plug constructed in accordance with the teachings of the present invention aligned for connection with the upper socket of a standard electrical outlet.
Figure 9:
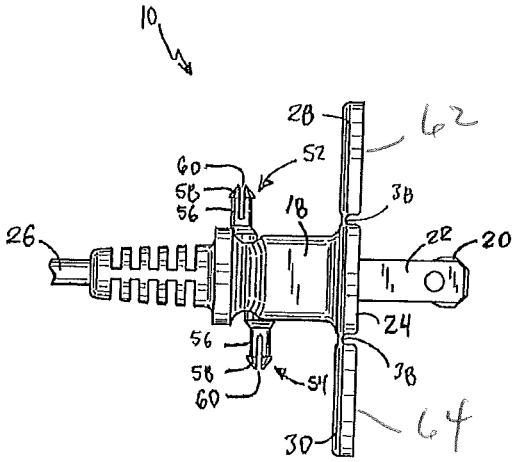
FIG. 9 is a side elevational view of the child-resistant plug of FIG. 8 illustrating the upper and lower tabs in unfolded positions.
Figure 10:
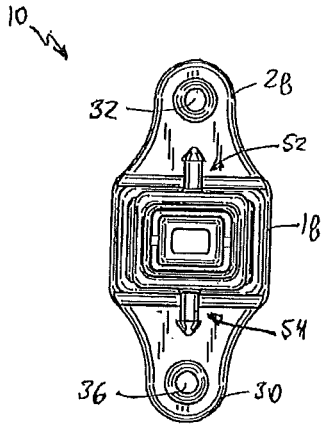
FIG. 10 is a rear elevational view of the child-resistant plug of FIG. 8 illustrating the upper and lower tabs in unfolded positions.

FIG. 8 includes another embodiment of the plug 10. In this embodiment, the upper tab 28 is a mirror image of the lower tab 30. This embodiment is intended primarily for use with standard receptacles 16. When inserted into the upper socket 72, the aperture 36 of the lower tab 30 is in line with center aperture 70 of the outlet's cover plate 68. The upper tab 28 may optionally be folded back. A second plug may be inserted into the lower socket 74. Likewise, when inserted into the lower socket 74, the aperture 32 of the upper tab 28 is in line with center aperture 70 of the outlet's cover plate 68. The lower tab 30 may optionally be folded back. A second plug may be inserted into the upper socket 72. Though not drawn as such in FIG. 9, the upper projection 52 and lower projection 54 may be equally spaced from the tabs 28 and 30, respectively, so that apertures 32 and 36 engage those projections when the tabs 28 and 30 are folded back.

Finally, in cases where semi-permanent securement is not required or preferred, a screw 50 is not inserted through either of the tabs 28 and 30. Optionally, the tabs 28 and 30 may be retained in their folded back positions in this instance as well.

Thus, there has been shown and described an embodiment of a novel child-resistant plug. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A child-resistant plug for semi-permanent securement to a cover plate of an electrical outlet, the plug comprising:

a plug body;

at least one prong; and a tab extending from the plug body, the tab hingedly connected to the plug body via a hinging member and being movable between a folded and an unfolded position, said tab further including at least one aperture;

said tab being sized and positioned such that when the plug is engaged with the electrical outlet and the tab is in its unfolded position, the at least one aperture in the tab aligns with a pre-existing aperture on the cover plate of the electrical outlet.

2. The child-resistant plug of claim 1 wherein a fastening member is insertable through the at least one aperture in the tab and the aligned pre-existing aperture on the cover plate.

3. The child-resistant plug of claim 1 wherein the hinge member is structured such that a pre-determined amount of pull force on the plug body causes the hinging member to break, allowing the plug to disengage from the electrical outlet.

4. The child-resistant plug of claim 1 wherein the at least one aperture in the tab includes two apertures, an upper aperture and a lower aperture.

5. The child-resistant plug of claim 4 wherein the electrical outlet is a ground fault interrupter outlet having an upper socket, and wherein when the plug is inserted into the upper socket of the ground fault circuit interrupter outlet, the upper aperture of said tab aligns with a pre-existing upper aperture in the cover plate.

6. The child-resistant plug of claim 4 wherein the electrical outlet is a standard electrical outlet having upper and lower sockets, and wherein when the plug is inserted into the lower socket of the standard outlet, the upper aperture of said tab aligns with a pre-existing ground prong slot in the upper socket of the standard outlet, and the lower aperture of said tab aligns with a pre-existing middle aperture in the cover plate.

7. The child-resistant plug of claim 4 wherein the electrical outlet is a ground fault interrupter outlet having a lower socket, and wherein when the plug is inserted into a lower socket of the ground fault circuit interrupter outlet, the lower aperture of said tab aligns with a pre-existing lower aperture in the cover plate.

8. The child-resistant plug of claim 4 wherein the electrical outlet is a standard electrical outlet having upper and lower sockets, and wherein when the plug is inserted into the upper socket of the standard outlet, the upper aperture of said tab aligns with a pre-existing middle aperture in the cover plate.

9. The child-resistant plug of claim 1 wherein the plug includes a projection extending from the plug body.

10. The child-resistant plug of claim 9 wherein said projection engages said at least one aperture on said tab when the tab is in its folded position.

11. The child-resistant plug of claim 4 wherein the plug includes a projection extending from the plug body, said projection engaging at least one of said upper and lower apertures on said tab when said tab is in its folded position.

12. The child-resistant plug of claim 1 including a second tab extending from the plug body, said second tab being hingedly connected to the plug body via a hinging member and being movable between a folded and an unfolded position, said second tab further including at least one aperture;

one of said tabs being positioned and located adjacent an upper portion of said plug body, and the other of said tabs being positioned and located adjacent a lower portion of said plug body.

13. A child-resistant plug for semi-permanent securement to a cover plate of an electrical outlet, the plug comprising:

a plug body;

at least one prong;

a first tab extending from an upper portion of said plug body, said first tab being hingedly connected to said plug body via a hinging member and being movable between a folded and an unfolded position, said first tab including at least one aperture;

a second tab extending from a lower portion of said plug body, said second tab being hingedly connected to said plug body via a hinging member and being movable between a folded and an unfolded position, said second tab including at least one aperture;

said first tab being sized and positioned such that when the plug is engaged with the electrical outlet and said first tab is in its unfolded position, the at least one aperture in said first tab aligns with a pre-existing aperture on the cover plate; and said second tab being sized and positioned such that when the plug is engaged with the electrical outlet and said second tab is in its unfolded position, the at least one aperture in said second tab aligns with a pre-existing aperture on the cover plate.

14. The child-resistant plug of claim 13 wherein the hinge members are structured such that a pre-determined amount of pull force on the plug body will cause the hinging members associated with said first and second tabs to break, allowing the plug to disengage from the electrical outlet.

15. The child-resistant plug of claim 13 wherein the electrical outlet is a ground fault interrupter outlet having an upper socket, and wherein when the plug is inserted into the upper socket of the ground fault circuit interrupter outlet, the at least one aperture associated with said first tab will align with a pre-existing upper aperture in the cover plate.

16. The child-resistant plug of claim 13 wherein the electrical outlet is a ground fault interrupter outlet having a lower socket, and wherein when the plug is inserted into the lower socket of the ground fault circuit interrupter outlet, the at least one aperture of said second tab will align with a pre-existing lower aperture in the cover plate.

17. The child-resistant plug of claim 13 wherein the electrical outlet is a standard electrical outlet having upper and lower sockets, and wherein when the plug is inserted into the upper socket of a standard outlet, the at least one aperture associated with said second tab will align with a pre-existing middle aperture in the cover plate.

18. The child-resistant plug of claim 13 wherein the electrical outlet is a standard electrical outlet having upper and lower sockets, and wherein when the plug is inserted into a lower socket of a standard outlet, the at least one aperture associated with said first tab will align with a pre-existing middle aperture in the cover plate.

19. The child-resistant plug of claim 13 wherein the electrical outlet is a standard electrical outlet having upper and lower sockets, said upper and lower sockets each including a ground prong slot, and wherein said first tab includes two apertures, an upper aperture and a lower aperture, and wherein when the plug is inserted into a lower socket of a standard electrical outlet, the upper aperture of said first tab will align with a pre-existing ground prong slot in the upper socket of the standard electrical outlet and the lower aperture of said first tab will align with a pre-existing middle aperture in the cover plate.

20. The child-resistant plug of claim 13 wherein the plug body includes at least one projection extending therefrom, said projection being positioned and located so as to engage at least one of the apertures associated with at least one of said first and second tabs when one of said first and second tabs is in its folded position.

21. A child-resistant plug for semi-permanent securement to a cover plate of an electrical outlet, the plug comprising:

a plug body;

at least one prong; and a tab extending from the plug body, the tab hingedly connected to the plug body via a hinging member and being movable between a folded and an unfolded position, said tab further including at least one aperture;

a projection extending from the plug body;

said tab being sized and positioned such that when the plug is engaged with the electrical outlet and the tab is in its unfolded position, the at least one aperture in the tab aligns with a pre-existing aperture on the cover plate of the electrical outlet; and wherein said projection engages said at least one aperture on said tab when the tab is in its folded position.

* * * * *